US009708804B2

(12) United States Patent
Palmer, II

(10) Patent No.: US 9,708,804 B2
(45) Date of Patent: Jul. 18, 2017

(54) DRAIN CLOG REMOVAL TOOL

(71) Applicant: Benjamin Colbert Palmer, II, Linville, NC (US)

(72) Inventor: Benjamin Colbert Palmer, II, Linville, NC (US)

( * ) Notice: Subject to any disclaimer, the term of this patent is extended or adjusted under 35 U.S.C. 154(b) by 0 days.

(21) Appl. No.: 14/962,854

(22) Filed: Dec. 8, 2015

(65) Prior Publication Data

US 2016/0168833 A1 Jun. 16, 2016

Related U.S. Application Data

(60) Provisional application No. 62/090,459, filed on Dec. 11, 2014.

(51) Int. Cl.
*E03D 9/00* (2006.01)
*E03C 1/306* (2006.01)

(52) U.S. Cl.
CPC ..... *E03C 1/306* (2013.01)

(58) Field of Classification Search
CPC ..... E03D 9/00
USPC ..... 4/255.01–255.12
See application file for complete search history.

(56) References Cited

U.S. PATENT DOCUMENTS 2,564,402 A * 8/1951 MacArthur ..... E03C 1/304 134/166 C
2,608,421 A * 8/1952 Schnepp ..... E03C 1/302 15/104.33
5,329,646 A * 7/1994 Bevacco ..... B08B 9/0322 4/255.08
5,384,918 A * 1/1995 Leighton ..... E03C 1/308 4/255.05
5,862,534 A * 1/1999 Clay ..... E03D 9/00 15/104.16
6,205,594 B1 * 3/2001 Solaberry ..... E03C 1/308 4/255.01
6,393,625 B1 * 5/2002 Tsai ..... E03C 1/308 4/255.02
6,941,589 B1 * 9/2005 Dural ..... B08B 9/032 4/255.01
8,418,275 B1 * 4/2013 Dondurur ..... E03D 9/00 4/255.04
9,273,452 B2 * 3/2016 Wilson ..... E03C 1/066
9,481,987 B2 * 11/2016 Salzer ..... E03C 1/304
2011/0056007 A1 * 3/2011 Caywood ..... E03C 1/302 4/255.11
2015/0020297 A1 * 1/2015 Durkin ..... E03D 11/00 4/255.03

* cited by examiner

*Primary Examiner* — Lori Baker
(74) *Attorney, Agent, or Firm* — The Van Winkle Law Firm; William G. Heedy; David M. Carter

(57) ABSTRACT

A drain clog removal tool is adapted for removable attachment to a drain line and delivery of a pressurized flow of water therethrough. The tool includes an airtight coupler component having a first end adapted for attachment with a drain pipe and an opposite second end adapted for attachment with a pressurized water source. In one embodiment, a flexible tube is provided for connecting the pressurized water source with the second end of the coupler component for allowing airflow communication therebetween. The coupler component includes a check valve for permitting one way water flow (towards the drain line) and a pressure gauge for visually indicating the pressure within the drain line during operation of the drain clog removal tool.

5 Claims, 3 Drawing Sheets

DRAIN CLOG REMOVAL TOOL

This application is based on and claims priority to provisional patent application No. 62/090,459 filed on Dec. 11, 2014.

BACKGROUND OF THE INVENTION

Field of the Invention

This invention relates to a device for removing clogs in a drain line and, more particularly, to a tool adapted for attachment to a drain line for delivery of a pressurized flow of water thereto for removal of a clog within the drain line.

Discussion of the Related Art

It is common for drain lines in sinks to occasionally become partially or entirely clogged, which results in a backup of water emitted by the sink faucet or otherwise introduced into the sink basin. The presence of a clog in a drain line can lead to a buildup of bacteria, algae and other debris that propagates the clog. Therefore, it is important to remove the drain clog in a timely manner.

One common prior art method of clearing and/or preventing clogs in a drain pipe is introducing a liquid or gel clog removal product into the drain line. Typically, these liquid or gel products include sodium hydroxide, sodium nitrate, sodium chloride and aluminum, and are not particularly safe from an environmental standpoint. Another common prior art method of removing drain clogs includes use of elongated mechanical tools sized for insertion into a drain line for manually loosening the clog. While each of these methods is useful for their intended purpose, neither provides a quick and simple method of completely flushing out the clog in the drain line.

Therefore, with the foregoing reasons in mind, there exists a need in the art for a tool that is easily securable to a drain line for delivering a pressurized flow of water therethrough in order to remove a partial or complete obstruction therein.

SUMMARY OF THE INVENTION

The present invention is directed to a drain clog removal tool adapted for removable attachment to a drain line and delivery of a pressurized flow of water therethrough. The tool includes an airtight coupler component having a first end adapted for attachment with a drain pipe and an opposite second end adapted for attachment with a pressurized water source. In one embodiment, a flexible tube is provided for connecting the pressurized water source with the second end of the coupler component for allowing liquid flow communication therebetween. The coupler component includes a check valve for permitting one way water flow (in the direction of the drain line) and a pressure gauge for visually indicating the pressure within the drain line during operation of the drain clog removal tool.

BRIEF DESCRIPTION OF THE DRAWINGS

For a fuller understanding of the nature of the present invention, reference should be made to the following detailed description, taken in conjunction with the accompanying drawings in which.

Like reference numerals refer to like reference parts throughout the several views of the drawings.

DETAILED DESCRIPTION OF THE PREFERRED EMBODIMENT

Referring to the several views of the drawings, the drain clog removal tool of the present invention for removing a partial or complete obstruction in a drain line 100 is shown and is generally indicated as 10.

Figure 1:
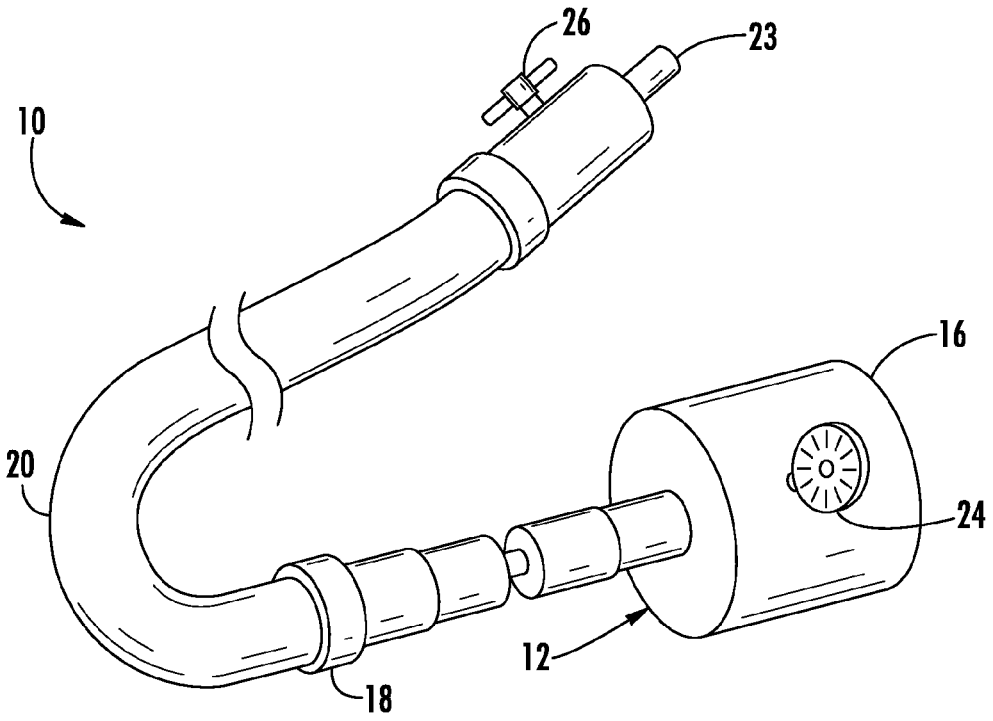
FIG. 1 is a perspective view of the drain clog removal tool of the present invention according to one embodiment.

Referring to FIG. 1, the drain clog removal tool 10 includes an airtight coupler component 12 surrounding a chamber 14 (FIG. 3) and including opposite open ends 16 and 18. First open end 16 is sized and configured for attachment with the open end of a drain pipe 100 in connection with the sewer line. Opposite second open end 18 is sized and configured for attachment with one end of an open-ended, flexible tube 20, which surrounds a fluid flow channel 22. The opposite end of the flexible tube 20 is configured for attachment with a source for providing a pressurized flow of water. In one embodiment, the opposite end of the flexible tube 20 is a threaded female end 23 configured for engaged, threaded receipt of a standard water hose nozzle. In one embodiment, the second end 18 of the coupler component 12 is configured for attachment with the pressurized source of water flow.

Still referring to FIG. 1, a pressure gauge 24 visually indicates the pressure within drain line 100 during operation of the drain clog removal tool 10. A valve 26 on the flexible tube 20 is provided for manually opening flow of water into the channel 22 from the source of pressurized water flow.

Figure 2:
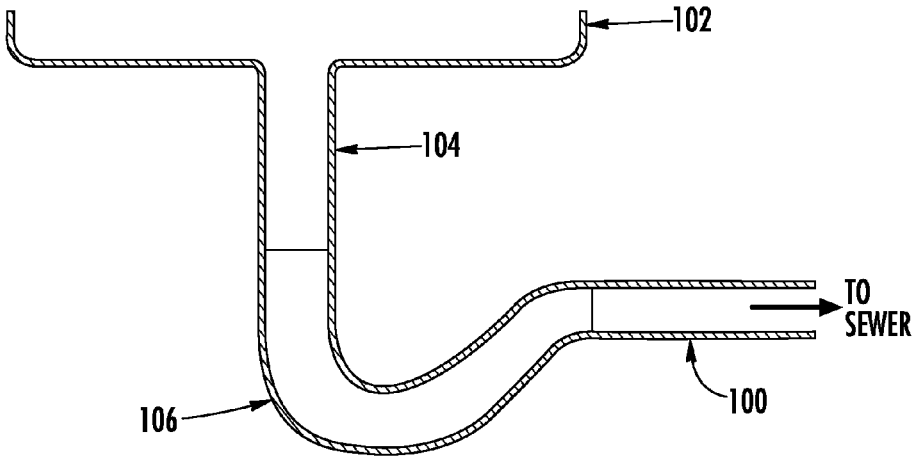
FIG. 2 is a side elevational view, shown in cross-section, illustrating a sink basin, sink drain pipe, trap adaptor, and drain pipe.

Referring to FIG. 2, a standard plumbing arrangement is shown wherein a sink basin 102 includes a sink drain pipe 104 that is coupled with the drain pipe 100 by a trap adaptor 106. The trap adaptor 106 is removable.

Figure 3:
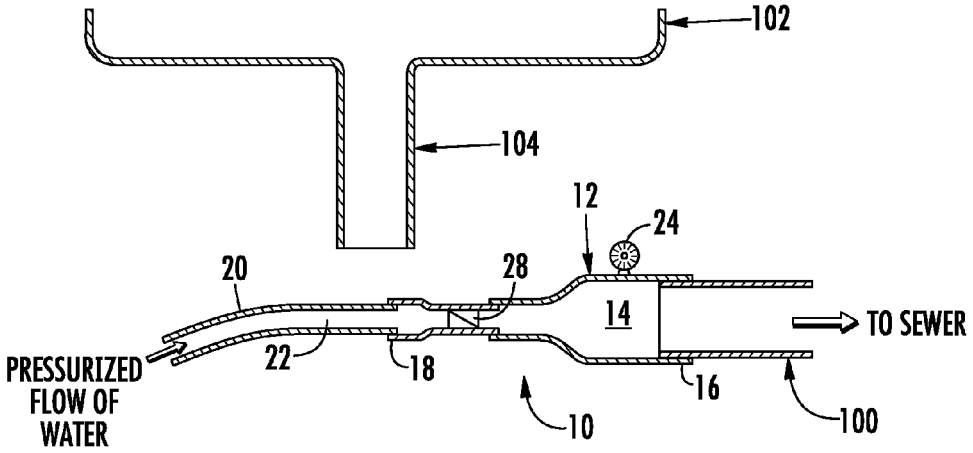
FIG. 3 is a side elevational view, shown in cross-section, illustrating the drain clog removal tool of the present invention secured to the drain pipe after removal of the trap adaptor.

Referring to FIG. 3, the trap adaptor 106 has been removed and the drain clog removal tool 10 is shown secured to the drain pipe 100. In operation, a pressurized flow of water is directed into the fluid flow channel 22 of the flexible hose 20. The pressurized flow of water may come from any such conventional source (e.g., sink faucet, outdoor faucet, or boiler drain on water heater). The valve 26 is opened to permit passage of water therethrough. The pressurized water passes through the chamber 14 of the coupler component 12 and enters the drain line 100. A check valve 28 in chamber 14 permits one-way passage of fluid therethrough in the direction of the drain line 100. During operation, the pressure gauge 24 displays the pressure within the drain line 100, wherein an abrupt drop in pressure indicates the obstruction within the drain line 100 has been cleared by the pressurized flow of water. Thereafter, the drain clog removal tool 10 is separated from the drain line 100 and the trap adaptor 106 is replaced.

Figure 4:
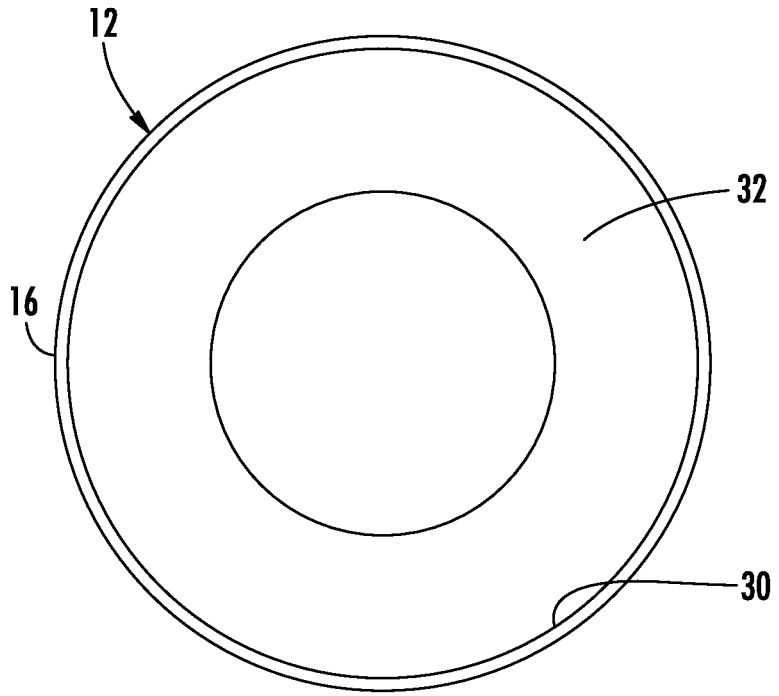
FIG. 4 is a front elevational view of the first opening of the airtight couple component of the present invention.

Referring to FIG. 4, the first open end 16 of the coupler component 12 may include a threaded interior surface 30 for engaged, threaded attachment with drain pipe 100. A gasket 32, such as a rubber gasket, is held within an annular, recessed lip on the interior surface 30 of the coupler component 12 and serves to provide an airtight seal between the coupler component 12 and the drain line 100. In one embodiment, the National Pipe Thread Taper (NPT) of the threaded interior surface 30 of the female open end 16 is 1½ inches for threaded, engaged receipt of an end of a standard sized drain line 100.

While the present invention has been shown and described in accordance with several preferred and practical embodiments, it is recognized that departures from the instant disclosure are contemplated within the spirit and scope of the present invention.

What is claimed is:

1. A device for removing clogs in a drain line, said device comprising:

an airtight coupler component surrounding a chamber and extending between a first end and a second end, and said first end including annular, recessed lip on the interior surface of said airtight coupler component;

said first end of said airtight coupler component being sized and configured for attachment with an open end of the drain pipe;

a gasket secured within the annular, recessed lip said airtight coupler component for providing an airtight seal between said chamber and the drain line;

a tube member surrounding an open ended channel and extending between a connector end and said second end of said airtight coupler component, said channel being in fluid flow communication with said chamber;

said connector end of said tube member being adapted for attachment with a pressurized water source; and a check valve on said airtight coupler component, said check valve being structured and disposed for permitting one way fluid flow in the direction of the first end of said airtight coupler component through the second end of said airtight coupler component and into the drain line for clearing the drain line of any clogs therein.

2. The device as recited in claim 1 further comprising a pressure gauge for visually indicating the pressure within the drain line during operation of the device.

3. The device as recited in claim 1 wherein said tube member is flexible.

4. The device as recited in claim 1 further comprising a valve on said tube member manually operable for permitting flow of water into said channel from the source of pressurized water flow.

5. The device as recited in claim 1 wherein said gasket is made from rubber.

* * * * *